United States Patent [19]

Stewart

[11] Patent Number: 4,608,743

[45] Date of Patent: Sep. 2, 1986

[54] MINING SHOVEL BALLAST BOX CONNECTION METHOD AND APPARATUS

[75] Inventor: Paul C. Stewart, Mt. Gilead, Ohio

[73] Assignee: Dresser Industries, Inc., Dallas, Tex.

[21] Appl. No.: 747,836

[22] Filed: Jun. 24, 1985

[51] Int. Cl.[4] ..... B23P 19/00; B66C 23/76; B66C 23/00

[52] U.S. Cl. ..... 29/526 R; 414/719; 212/195

[58] Field of Search ..... 212/195; 414/690, 719; 29/526 R

[56] References Cited

U.S. PATENT DOCUMENTS

| | | | |
|---|---|---|---|
| 3,266,636 | 8/1966 | Dorn | 414/719 |
| 3,533,524 | 10/1970 | Wilcox | 414/719 |
| 3,795,330 | 3/1974 | Jorgensen et al. | 414/719 |
| 4,081,081 | 3/1978 | Morrow et al. | 212/195 |
| 4,402,413 | 9/1983 | Sickler | 414/719 |
| 4,537,423 | 8/1985 | Nan | 212/195 |

FOREIGN PATENT DOCUMENTS

| | | | |
|---|---|---|---|
| 1009986 | 8/1981 | U.S.S.R. | 212/195 |

*Primary Examiner*—Mark Rosenbaum
*Assistant Examiner*—Steven Nichols

[57] ABSTRACT

The ballast box of a power mining shovel is coupled to the rotating frame by two pins installed through orifices in parallel plate projections extending from the ballast box and corresponding eye projections on the main rotating frame. In addition, the feet of the gantry rear legs are pinned through second orifices in the same parallel plate projections from the ballast box such that the force generated down the center of the longitudinal axis of the gantry rear leg is coupled through the centers of both of the orifices in the parallel plate projections.

10 Claims, 7 Drawing Figures

MINING SHOVEL BALLAST BOX CONNECTION METHOD AND APPARATUS

BACKGROUND OF THE INVENTION

The present invention relates to the attachment of ballast box structures to mining shovel rotating frames and in particular relates to a method and apparatus for conserving deck space on the mining shovel and reducing working load on the pins coupling the ballast box to the rotating frame by pinning the feet of each gantry rear leg through a corresponding orifice in a ballast box projection in axial alignment with the pin holding the ballast box to the rotating frame projection and the longitudinal axis of a corresponding gantry rear leg.

Large mining machine shovels comprise a stationary lower frame coupled to a main rotating frame by a center journal and bearing roller circle. Because these machines weigh millions of pounds and because of the tremendous forces exerted by the shovel in the forward portion of the machine in digging materials, a ballast box weighing several hundred thousand pounds must be attached to the rear of the main rotating frame in order to balance the structure. Typical field installation of ballast box structure to the rotating frames of the shovel in the past have employed bolted or welded connections. Where there are a plurality of bolted connections, the orifices for the bolts require precision machining and obviously the more bolt connections that are required the more precision machining is required. In addition, the bolts which are used to form the connections must be accurately preloaded or torqued and, of course, the more bolts that are used in the connection the greater the time required to do the preloading or torquing of the bolts when mounting the ballast box structure to the rotating frame. It is necessary that this accurate preloading take place in order to avoid fatigue failure of the bolts.

In other cases where welded connections are used to attach the ballast box structure to the shovel rotating frame, the shovel not only loses its modular construction because of the permanent welding of the ballast box structure to the rotating frame but also welded connections are very time consuming to perform when there is a large number of welds to be made. In addition, the welds must be accurately formed since poor weld quality promotes fatigue cracking.

The main rotating frame also supports an inverted V-shaped gantry which has cables coupled from its outer end to the outer end of the shovel boom to which the dipper or shovel and its associated arm are attached. The inverted V-shaped gantry has forward and rear legs attached to eye projections on the rotating frame.

The present invention maintains the modular construction of the power shovel with respect to the ballast box structure, conserves deck space of the power shovel and reduces working load on the pins coupling the ballast box to the rotating frame by forming projections on the ballast box which attach to eye projections on the rotating frame previously used to attach the gantry rear legs and then pinning the rear legs of the gantry through a second orifice on the ballast box projections instead of the eye projections on the rotating frame.

Thus, it is an object of the present invention to removably attach the gantry rear legs to the ballast box attaching projections instead of to the rotating frame eye projection.

It is still another object of the present invention to rigidly attach first and second pairs of parallel plate projections on the ballast box having first and second spaced orifices therein, attaching the ballast box to the rotating frame by mounting a pin through a first orifice of each of the pairs of parallel plates and the eye of a corresponding rotating frame projection while attaching each gantry rear leg to the second orifice in corresponding ones of the parallel plate projections.

It is yet another object of the present invention to form the first and second spaced orifices in each of the ballast box pair of parallel plate projections such that the center of each of said first and second orifices lies on a line corresponding to the center of the longitudinal axis of said gantry rear leg.

SUMMARY OF THE INVENTION

Thus the present invention relates to an improved method of attaching a ballast box to a mining shovel rotating frame, said frame having an inverted V-shaped gantry for supporting the shovel boom, said gantry having forward and rear legs attached to eye projections on said rotating frame, the improvement comprising the steps of forming means on said ballast box for removable attachment of said ballast box to said rotating frame eye projections for said gantry rear legs, and removably attaching said gantry rear legs to said ballast box attaching means instead of to said rotating frame projections.

The invention also relates to apparatus for attaching a ballast box to a mining shovel rotating frame, said frame having an inverted V-shaped gantry for supporting the shovel boom, said gantry having forward and rear legs attached to eye projections on said rotating frame, the improvement comprising means on said ballast box for removable attachment of said ballast box to said rotating frame eye projections for said gantry rear legs, and means for removably attaching said gantry rear legs to said ballast box attaching means instead of to said rotating frame projections.

BRIEF DESCRIPTION OF THE DRAWINGS

These and other objects of the present invention will be disclosed in conjunction with the accompanying drawings in which like numerals represent like components and in which.

DETAILED DESCRIPTION OF THE DRAWINGS

Figure 1:
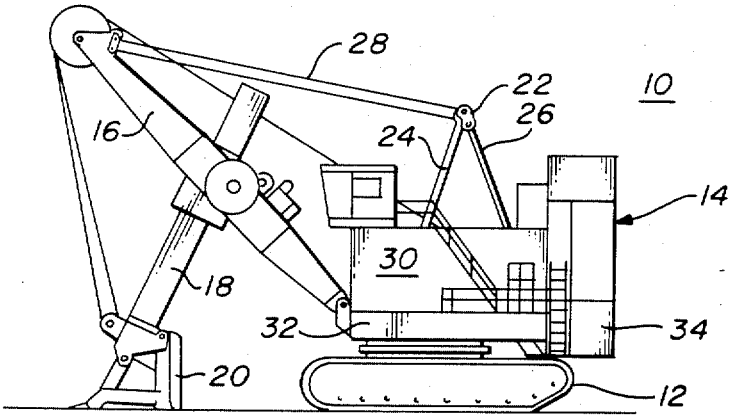
FIG. 1 is a side view of a typical mining shovel illustrating the stationary portion, the rotatable portion including the main rotating frame and the attached ballast box, the boom, the dipper and handle and the gantry.

FIG. 1 is a diagrammatic side view of a typical power mining shovel 10 which includes a lower base 12 and an upper rotatable portion 14. A boom 16 is pivotally attached to the front end thereof and a handle 18 pivotally and extensibly attached to boom 16 and has a dipper or shovel 20 at the outer end thereof. A gantry 22 has front legs 24 and rear legs 26 attached to the main rotating frame 32 and support cables 28 which hold boom 16 in its proper position. The main housing 30 including the operator's cab and all of the control units and power units is mounted on rotatable main frame 32. In addition, because the forward end of the shovel including boom 16, handle 18 and shovel 20 is so heavy and the forces applied to the shovel are so great, a large ballast box 34 is attached to main rotating frame 32. This ballast box 34 may weigh several hundred thousand pounds and serves as a counterweight to all of the forces generated on the forward end of the power shovel by the bucket 20 and the attached components.

It is desired, if possible, to make the attachment of ballast box 34 to main rotating frame 32 a modular unit which may be removed as necessary.

Figure 2:
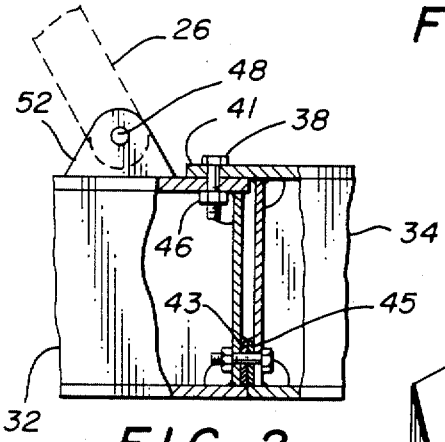
FIG. 2 PRIOR ART
FIG. 2 is a schematic representation of one prior art manner of attaching the ballast box to the rotating main frame.
Figure 4:
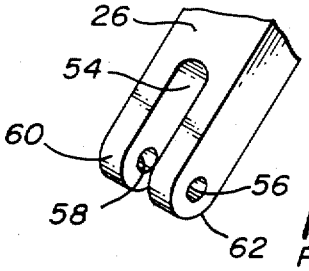
FIG. 4 PRIOR ART
FIG. 4 is a partial view of a prior art gantry rear leg illustrating the clevis shape which is required for connection to eye projections on the rotating frame.

One prior art method of attaching the ballast box 34 to the main rotating frame 32 is shown in FIG. 2. As can be seen in FIG. 2, ballast box 34 has a plurality of large bolts 38 (only one of which is shown) which pass through corresponding orifices in overlapping horizontal projections or lips 41 and 42 and are held therein by means of nuts 46 (only one of which is shown). Because ballast box 34 is so heavy, it is obvious that the bolts 38 and corresponding nuts 46 must be of very large construction and must consist of a plurality of them. For ease of illustration, only one bolt 38 and one nut 46 are shown. Further, it is required that precise machining of the orifices in overlapping projections 41 and 42 be made and an accurate preload or torquing of the large nuts 46 be performed in order to avoid fatigue failure of the bolts 38 and the nuts 46. This is extremely time consuming because of the number and size of these bolts and, as indicated earlier, requires a great deal of precision machining in order to properly match the bolts and eye projections when attaching ballast box 34 to the rotating main frame 32. As can be seen in FIG. 2, one of the rear gantry legs 26 is shown being attached to a vertical eye projection 50 through which pin 51 (shown in FIG. 5) is passed to attached gantry leg 26 to the main frame 32. Only one of the gantry rear legs is shown but the other leg would be attached to vertical projection 52 in a similar manner. Also as can be seen in FIG. 4, the gantry leg is U-shaped or clevis shaped in order to fit over or on each side of, vertical projections 50 and 52. As can be seen in FIG. 4, the lower portion or foot of rear gantry leg 26 terminates in leg portions 60 and 62 formed by the U-shaped or clevis shaped channel 54. This channel is placed over projection 50 or 52 shown in FIG. 2 and a pin 51 passes through eyes 56 and 58 (FIG. 4) and the corresponding eye in either projection 50 or 52 to rigidly couple the foot of leg 26 to the rotating main frame 32.

Figure 3A:
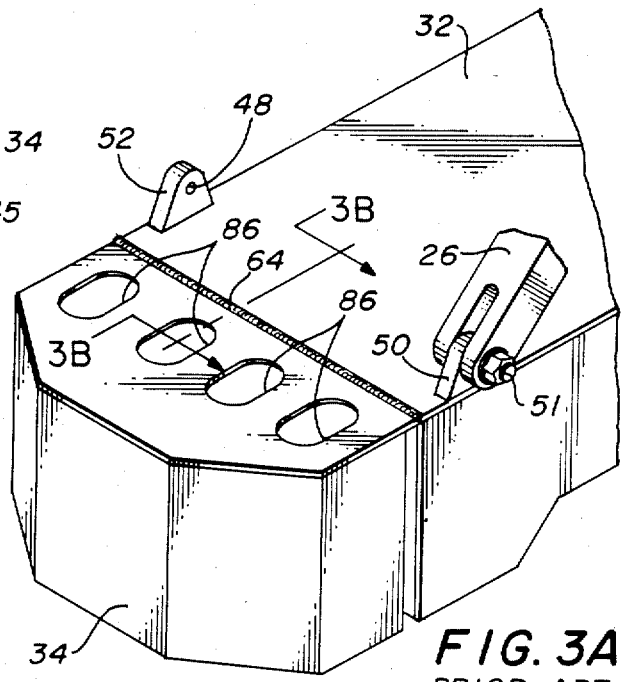
FIG. 3A PRIOR ART
FIG. 3A illustrates an alternate prior art manner of attaching the ballast box to the rotating main frame.
Figure 3B:
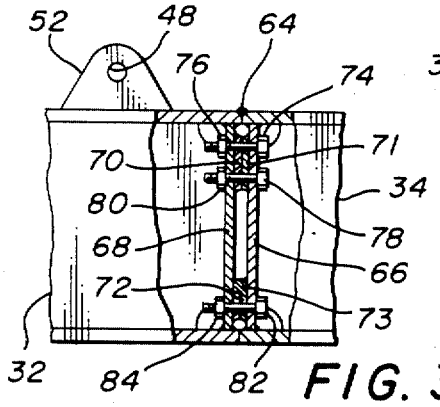
FIG. 3B is a cut-away detail view of FIG. 3A.

Another method of attaching the ballast box 34 to the rotating main frame 32 is shown in FIG. 3A. In this method, it will be seen that ballast box 34 has an upper edge 64 which mates with the upper edge of the rotatable main frame 32 and it is welded at that point. As can be seen, end wall 68 (FIG. 3B) of rotatable main frame 32 is separated from the end wall 66 of ballast box 34. Finish pads 70 and 72 are placed between end plates 66 and 68 and bolts 74, 78 and 82 are placed therethrough with nuts 76, 80 and 84 placed thereon and tightened according to an accurate preload or torque. A plurality of bolts 74, 78 and 82 extend across the face of plate 66 and 68 and can be reached through openings 86 in ballast box 34 (FIG. 3A) so that they can be tightened and checked as necessary. As indicated earlier, weld connection 64 requires time consuming weld procedures under adverse field conditions and if poor weld quality occurs, fatigue cracking is promoted. In addition, it is time consuming to torque all of the coupling bolts 74, 78 and 82 to the proper torque or preload.

Figure 5:
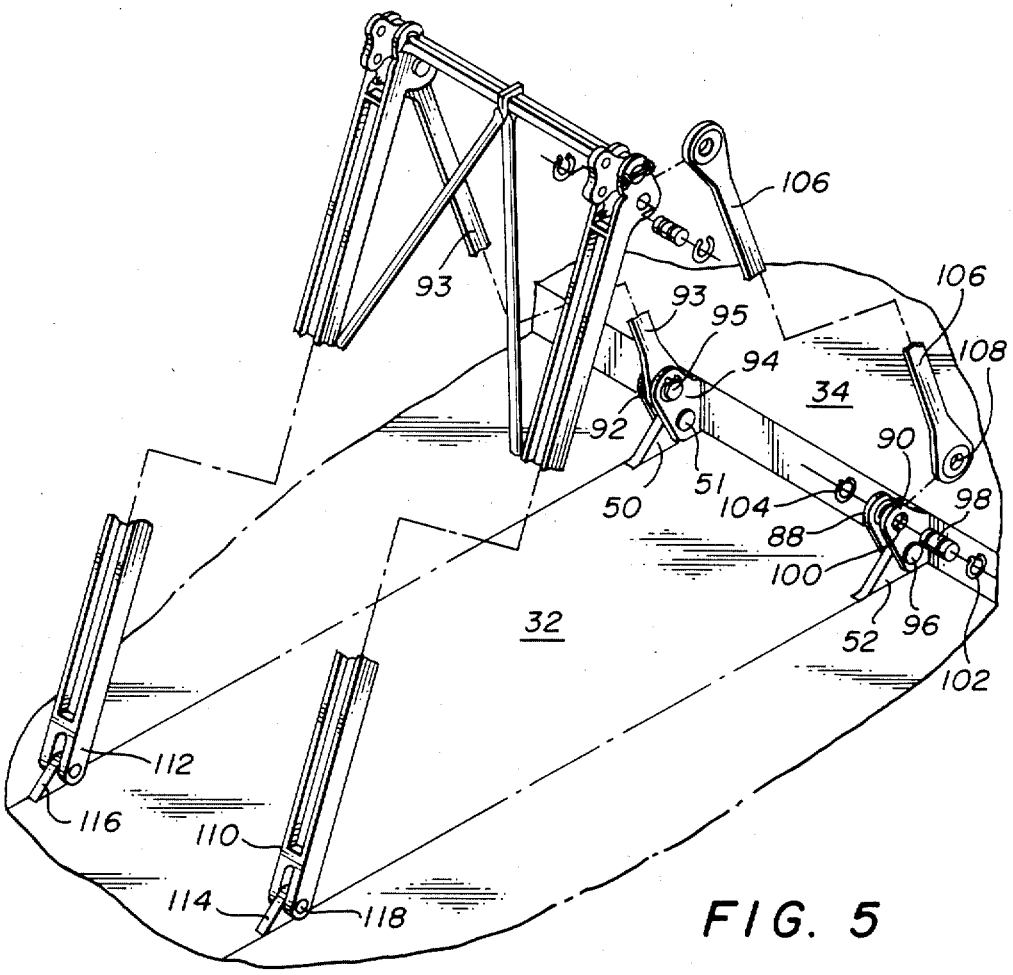
FIG. 5 is a schematic representation of the present invention in which the gantry is coupled at its front legs to the rotatable frame and by the rear legs to ballast box projections at a point on the projections other than that point which is used to couple the ballast box to the rotating frame.

FIG. 5 is a partial isometric view of the ballast box 34 and rotating frame structure 32 illustrating how the V-shaped gantry is attached thereto. As can be seen in FIG. 5, a first pair of parallel plate projections 88 and 90 are rigidly attached to ballast box 34 in any well known manner such as by welding. Each of the plate projections 88 and 90 has first orifice 96 and a second orifice 100 therein. The vertical eye projection 52 on the rotating frame structure 32 mates with the parallel plate projections 88 and 90 by being sandwiched therebetween and a pin is placed through orifice 96 which extends through an orifice such as the orifice 48 (shown in FIG. 2) in the rotating frame eye projection 52 and through the corresponding orifice in plate 88 to attach the ballast box 34 to the rotating frame structure 32. A second pair of parallel plate projections 92 and 94 extend from ballast box 34 and mate with corresponding rotating frame eye projection 50 in a similar manner whereby a pin 51 secures ballast box 34 to the rotating frame structure 32.

It will also be noted that the rear leg 106 of the gantry is plate shaped and at the foot thereof has an orifice 108 which is sandwiched between parallel plate projections 88 and 90 so that orifice 108 mates with the orifice 100 in each of the parallel plate projections 88 and 90. A pin 98 placed therethrough secures the rear leg 106 of the gantry to parallel plate projections 88 and 90 and therefore to ballast box 34. The other rear leg 93 of the gantry is secured to parallel plate projections 92 and 94 in a similar manner by a pin 95. Pins 95 and 98 may be secured in any well known manner such as by snap rings or cotter pins.

The forward legs 110 and 112 of the gantry are secured to the rotating frame 32 by being coupled to rotating frame eye projections 114 and 116 by means of pins such as 118. It will be noted that the front legs at the feet thereof have a U-shaped or clevis shaped construction which allows the projections to be placed on each side of the vertical eye projections 114 and 116 so that they can be secured by pin 118. However, the reverse is true with the rear legs 93 and 106. They are each formed as a flat plate which is sandwiched between the pair of parallel plate projections 88 and 90 and 92 and 94 on the ballast 34.

Figure 6:
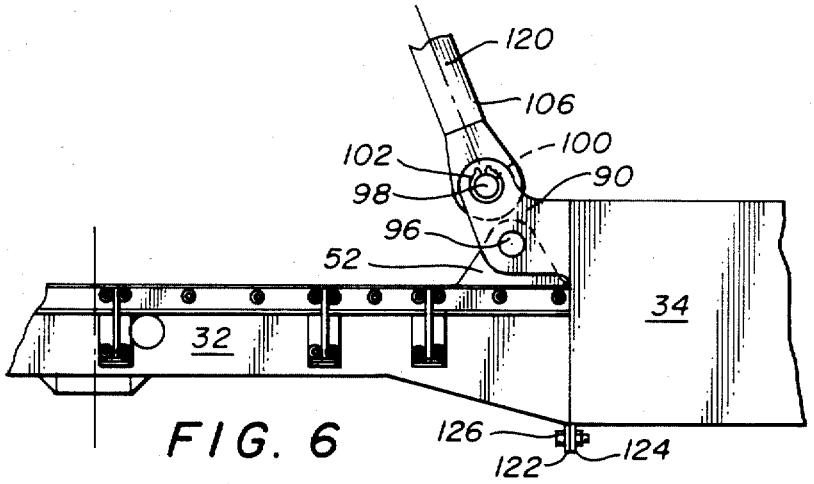
FIG. 6 is a partial side view of the main frame in the ballast box illustrating the projection on the ballast box having first and second orifices therein which are in alignment with each other and with the longitudinal axis of the rear gantry leg and one of which orifices is used to attach the ballast box to the rotating frame and the other of which orifices is used to attach the rear gantry leg thereto.

FIG. 6 is a partial schematic side view of the rotating frame 32, the ballast box 34 and illustrating the manner in which the rear leg 106 of the gantry is coupled thereto. As can be seen in FIG. 6, ballast box 34 has extending therefrom one of the parallel plate projections 90 which has in it orifices 96 and 100. The rotating frame vertically extending eye projection 52 is mated between the parallel plate projections 90 and 88 as explained earlier and a pin is placed through orifice 96 to hold the ballast box 34 attached to vertically extending eye projection 52 and thus rotating frame 32. It can also be seen in FIG. 6 that the rear leg 106 of the gantry is coupled to the parallel plate projections 88 and 90 extending from ballast box 34 by means of a pin placed through orifice 100 and which also extends through orifice 108 (shown in FIG. 5) of gantry rear leg 106. It will be noted that orifices 96 and 100 in the parallel plate projections 88 and 90 extending from the ballast box 34 are in alignment with each other and are formed such that the center of each of these orifices lies on a line corresponding to the center of the longitudinal axis 120 of gantry rear leg 106. Thus, the forces developed by gantry rear leg 106 and ballast box 34 are divided between the pins placed in orifices 96 and 100. Therefore, smaller pins can be used to attach the ballast box 34 to the rotating frame 32 and to attach the rear leg 106 of the gantry to the rotating frame 32 than would be required if the orifices 96 and 100 were not in alignment with the longitudinal axis of the rear gantry leg 26. Further, because the two pins are on the gantry leg centerline, no moment arms exist between the pins. The lower portion of ballast box 34 is held tightly against rotating frame 32 by means of projecting lips 122 and 124 which have bolt 126 passing therethrough. No load is placed on these bolts 126 and they simply keep the ballast box 34 from moving with respect to rotating frame 32 as the shovel is subjected to various forces and movements.

Thus, because there are far less bolted connections in the present invention than in the prior art method of attaching the ballast box to the rotating frame structure, there is much less machining required. Further, the construction permits the use of a flat plate in the gantry rear leg design which is of simpler construction and less expensive. Because only four pins are required to attach both the ballast box and the gantry rear legs to the rotating frame structure, the time for field assembly is simplified and reduced. Further, there is no weld quality or bolt preload or torquing to control or inspect. Thus, maintenance inspection is reduced and potential fatigue failure is reduced. Further, as stated earlier, smaller pins may be used to connect the ballast box to the rotating frame structure because of the alignment of the attaching pins with the gantry rear leg pins. Further, by coupling the gantry rear legs in the manner indicated, deck space is conserved and the working load on the ballast box/rotating frame pins is reduced.

While the invention has been described in connection with a preferred embodiment, it is not intended to limit the scope of the invention to the particular form set forth, but, on the contrary, it is intended to cover such alternatives, modifications and equivalents as may be included within the spirit and scope of the invention as defined in the appended claims.

I claim:

1. An improved method of attaching a ballast box to a mining shovel rotating frame, said frame having an inverted V-shaped gantry for supporting the shovel boom, said gantry having forward and rear legs attached to respective eye projections on said rotating frame, the improvement comprising the steps of:

a. disconnecting said rear legs of said gantry from said respective rotating frame eye projections, b. forming means on said ballast box for removable attachment of said ballast box to said respective rotating frame eye projections normally used for said gantry rear legs, and c. removably attaching said gantry rear legs only to said ballast box attachment means.

2. A method as in claim 1 further including the step of attaching said gantry rear legs to said ballast box attaching means at a point other than on said rotating frame eye projections.

3. A method as in claim 2 further comprising the steps of:

a. rigidly attaching first and second pairs of parallel plate projections on said ballast box, each projection pair of plates having first and second spaced orifices therein, b. mounting a first pin through said first orifice in each of said pair of parallel plates and the eye of a corresponding rotating frame projection to attach said ballast box to said rotating frame, and c. attaching each said gantry rear leg to said second orifice in a corresponding one of said parallel plate projections to support said gantry rear legs.

4. A method as in claim 3 further comprising the steps of:

a. forming at least an end portion of each of said gantry rear legs in the shape of a rectangular plate with an orifice therein, b. inserting said plate portion of said leg with said orifice between a corresponding pair of said parallel plate projections on said ballast box, and c. mounting a second pin through said second orifice in each of said parallel plate projections and said gantry leg orifice to attach each gantry leg to a corresponding pair of ballast box parallel plate projections.

5. A method as in claim 4 further comprising the step of forming said first and second spaced orifices in each of said ballast box pair of parallel plate projections such that the center of each of said first and second orifices lies on a line corresponding to the center of the longitudinal axis of said gantry rear leg.

6. Apparatus for attaching a ballast box to a mining shovel rotating frame, said frame having an inverted V-shaped gantry for supporting the shovel boom, said gantry having forward and rear legs attached to respective eye projections on said rotating frame, the improvement comprising:

a. means on said ballast box for removable attachment of said ballast box to said respective rotating frame eye projections for said gantry rear legs, and b. means for removably attaching said gantry rear legs only to said ballast box attaching means.

7. Apparatus as in claim 6 further including means for attaching said gantry rear legs to said ballast box attaching means at a point other than on said rotating frame eye projections.

8. Apparatus as in claim 7 further including:

a. first and second pairs of parallel plate projections rigidly attached to said ballast box with each projection pair of plates having first and second spaced orifices therein, b. a pin mounted through said first orifice of each of said pair of parallel plates and the eye of a corresponding rotating frame projection to attach said ballast box to said rotating frame, and c. means for attaching each said gantry rear leg to said second orifice in a corresponding one of said parallel plate projections to support said gantry rear legs.

9. Apparatus as in claim 8 further including:

a. at least an end portion of each of said gantry rear legs being formed in the shape of a rectangular plate with an orifice therein for insertion between a corresponding pair of said parallel plate projections on said ballast box, and b. a pin mounted through said second orifice in each of said parallel plate projections and said gantry leg orifice to attach each gantry leg to a corresponding pair of ballast box parallel plate projections.

10. Apparatus as in claim 9 further including means for applying any force coupled to said gantry rear leg to both said first and second pins in said first and second spaced orifices by forming said first and second spaced orifices in each of said ballast box pairs of parallel plate projections such that the center of each of said first and second orifices lies on a line corresponding to the center of the longitudinal axis of said gantry rear leg.

* * * * *